US005971147A

United States Patent [19]

Sutter

[11] Patent Number: 5,971,147

[45] Date of Patent: Oct. 26, 1999

[54] MOLDED ONE-PIECE GOLF CLUB ORGANIZER STRUCTURE AND ORGANIZING ASSEMBLY USING SAME

[75] Inventor: James L. Sutter, Evergreen, Colo.

[73] Assignee: Great Divider Golf, Inc., Golden, Colo.

[21] Appl. No.: 09/113,600

[22] Filed: Jul. 10, 1998

[51] Int. Cl.[6] ..... A63B 55/04

[52] U.S. Cl. ..... 206/315.6; 211/70.2

[58] Field of Search ..... 206/315.2, 315.3, 206/315.5, 315.6, 315.8; 211/70.2

[56] References Cited

U.S. PATENT DOCUMENTS

| | | | |
|---|---|---|---|
| 1,798,638 | 3/1931 | Stone et al. . | |
| 1,968,723 | 7/1934 | Thorsen | 206/315.6 |
| 4,172,484 | 10/1979 | Henning . | |
| 4,596,328 | 6/1986 | Solheim . | |
| 4,691,823 | 9/1987 | Pape | 206/315.6 |
| 4,709,814 | 12/1987 | Antonious | 206/315.3 |
| 5,123,531 | 6/1992 | Beretta . | |
| 5,226,533 | 7/1993 | Antonious | 206/315.6 |
| 5,431,278 | 7/1995 | Gretz . | |
| 5,450,954 | 9/1995 | Dunn | 206/315.5 |
| 5,573,112 | 11/1996 | Kim . | |
| 5,671,843 | 9/1997 | Sutter . | |
| 5,860,520 | 1/1999 | Tang | 206/315.6 |

*Primary Examiner*—Gary E. Elkins
*Assistant Examiner*—Tri M. Mai
*Attorney, Agent, or Firm*—Flanagan & Flanagan; John R. Flanagan; John K. Flanagan

[57] ABSTRACT

A molded one-piece golf club organizer structure and organizing assembly includes a molded one-piece framework and a golf bag top collar. The framework includes first and second divider members extending in intersecting relationships with one another so as to form compartments between the divider members for receiving shafts of golf clubs placed in the carrying bag. The top collar includes an annular body encircling the framework. Connector tabs are integrally fixed on opposite ends of the first and second divider members. The annular body has a plurality of apertures defined therethrough in spaced apart relation to one another. Each aperture receives a respective one of the connector tabs for securing the framework to the top collar such that the annular body is retained in a wrapped relation about the framework. Each first divider member has a height greater than the height of each second divider member. The assembly further includes first and second covering strips folded and applied over the first and second divider members such that they completely cover the first and second divider members of the framework.

8 Claims, 3 Drawing Sheets

MOLDED ONE-PIECE GOLF CLUB ORGANIZER STRUCTURE AND ORGANIZING ASSEMBLY USING SAME

CROSS-REFERENCE TO RELATED APPLICATION

Reference is hereby made to a copending patent application, Ser. No. 08/917,431 filed Aug. 19, 1997, by the same inventor.

BACKGROUND OF THE INVENTION

1. Field of the Invention

The present invention generally relates to arranging golf clubs in carrying bags and, more particularly, is concerned with a molded one-piece golf club organizer structure and organizing assembly comprised of the molded one-piece golf club organizer structure and a golf bag top collar encircling and attached to the organizer structure.

2. Description of the Prior Art

Golf clubs are often carried in a sleeve-like bag designed for that purpose. A basic prior art golf club carrying bag has a tubular sidewall open at an upper end and closed at a lower end by a bottom end wall. An interior of the bag defines a cavity in which the golf clubs are stored vertically with their handgrip ends down so that heads of the clubs extend above the open upper end of the bag.

As is well-known, golf clubs generally differ from one another in terms of lengths of their shafts, shapes and sizes of their heads, and angles at which their golf ball striking surfaces extend relative to a horizontal plane. Golfers select one of the clubs to use for any given stroke depending on the particular placement of the ball whether in the rough or on the tee, fairway or green and the distance of the ball from the hole. As a result, many golfers prefer to maintain their clubs in their bag in some organized fashion so that they can quickly locate and replace the one club they have selected to use for the particular stroke at hand.

The basic design of the prior art golf bag does not provide a means to organize the clubs in the bag. As the bag is moved and jostled about during a round of play, the clubs will bump each other and move around in the bag relative to one another and will be disorganized causing the golfer to constantly search for the selected club. The bumping of the clubs against one another may also result in wear on the handgrip surfaces and dings and nicks on the club heads. In an effort to address these problems with the basic prior art bag, a variety of prior art approaches to bag design for better arranging and organizing golf clubs in the bags have occurred over the years.

In one prior art approach, individual divider members are arranged and connected to one another and to a top collar of the golf bag to provide an organizer structure across the open top end of the bag. In one example of this approach exemplified in U.S. Pat. No. 5,123,531 to Beretta, the bag at the open upper end is provided with a front-to-back extending rigid central bar and a pair of front-to-back spaced apart rigid cross bars. The opposite ends of the bars extend through and are secured to the top collar of the bag. In another example of this approach exemplified in U.S. Pat. No. 1,798,638 to Stone et al, U.S. Pat. No. 4,172,484 to Henning and U.S. Pat. No. 5,573,112 to Kim, divider panels of cloth or plastic sheets in various patterns are arranged across and attached to and extend downward from the top collar of the bag to form multiple separate compartments. In another prior art approach exemplified in U.S. Pat. No. 4,596,328 to Solheim and U.S. Pat. No. 5,431,278 to Gretz, an organizer structure is provided in the form of a one-piece injection molded top cap which fits on the open top end of the tubular body of the golf bag. The one-piece top cap has a continuous outer ring-shaped member integrally connected with the integrally connected inner divider members to form compartments with one another and with the outer side wall. The Solheim patent also discloses alternative organizer structures wherein the inner divider members are provided as a separately molded insert which fit into and are secured to a separately molded outer ring-shaped member. The insert is secured to the outer ring-shaped member by a plurality of rivets which connect ends of the divider members of the insert to spaced portions of the outer ring-shaped member or by a strap which is threaded through the hollow interiors of the divider members and through openings in the outer ring-shaped member and whose opposite ends are then connected together by a fastener buckle located on the exterior of the outer ring-shaped member.

The above-described approaches have many drawbacks in terms of the complexity of their designs that would appear to result in unacceptably low reliability and high costs in their manufacture and assembling, not to mention that most fall short of maintaining the golf clubs in a desirable organized arrangement. Thus, a need exists for a more optimum solution which overcomes these drawbacks without introducing any new problems in their place.

SUMMARY OF THE INVENTION

The present invention provides a molded one-piece golf club organizer structure and organizing assembly employing the organizer structure which is designed to satisfy the aforementioned need. The molded one-piece golf club organizer structure and organizing assembly of the present invention overcomes the drawbacks of the prior art by reducing the complexity and the cost of manufacturing and assembling the two basic components of the organizing assembly and by substantially increasing the consistancy, reliability and durability of the final product by reducing the number of parts needed to be assembled and eliminating the need for skilled personnel to accurately assemble the parts together.

Accordingly, the present invention is directed to a golf club organizer structure which comprises: (a) a molded one-piece framework including pluralities of first and second divider members; (b) each of the first and second divider members of the framework having opposite ends and spaced upper and lower longitudinal edges extending between the opposite ends; (c) the first divider members of the framework extending in intersecting relationships with the second divider members of the framework so as to form a plurality of compartments between the divider members of the framework for receiving shafts of golf clubs placed in a carrying bag; (d) each of the opposite ends of more than half of the first and second divider members of the framework having a connector tab integrally fixed thereon for securing the framework to a top collar of the carrying bag.

The connector tabs at the opposite ends of those of the first and second divider members of the framework having the connector tabs extend in opposite directions from the opposite ends of the divider members to provide generally T-shaped configurations therewith and lie along an annular path conforming to a shape of the top collar of the carrying bag to which the framework is secured by the connector tabs. Each of the first divider members has a height which is greater than a height of each of second divider members such that the upper longitudinal edge of each of the first divider members is disposed above the upper longitudinal edge of each of the second divider members while the lower longitudinal edges of the first and second divider members extend in a common plane.

The present invention is also directed to a golf club organizer structure which comprises: (a) a molded one-piece framework including pluralities of first and second divider members; (b) each of the first and second divider members of the framework having opposite ends, spaced upper and lower longitudinal edges extending between the opposite ends and oppositely facing surfaces extending between the upper and lower longitudinal edges; (c) the first divider members of the framework extending in an intersecting relationship with the second divider members of the framework so as to form a plurality of junctures therewith and a plurality of compartments between the divider members of the framework for receiving shafts of golf clubs placed in a carrying bag; (d) each of the first divider members of the framework having a height which is greater than a height of each of the second divider members of the framework such that the upper longitudinal edges of the first divider members are disposed above the upper longitudinal edges of the second divider members; and (e) means for securing the framework to a top collar of the carrying bag.

The securing means includes the plurality of connector tabs integrally fixed on the opposite ends of more than half of the first and second divider members of the framework and which are securable to the top collar of the carrying bag. The organizer structure further comprises a plurality of first and second covering strips respectively applied over the first and second divider members of the framework and along the oppositely facing surfaces thereof.

Each of the first covering strips is folded along an imaginary longitudinal fold line over the upper longitudinal edge of one of the first divider members of the framework and is continuous between the opposite ends of the first divider member along the upper longitudinal edge so as to completely overlie and cover the higher upper longitudinal edge of the first divider member. Each of the first covering strips has a pair of opposite longitudinal edges and pairs of spaced apart and aligned slits respectively formed in the first covering strip transversely to the imaginary longitudinal fold line and at the junctures of the first divider member with the second divider members to provide slots in the first covering strip for accommodating the second divider members of the framework. The slits of each pair thereof has inner ends spaced apart in opposite directions from the imaginary longitudinal fold line of the first covering strip and extend to outer ends located at the opposite longitudinal edges of the first covering strip such that the slots are open at the opposite longitudinal edges thereof.

Each of the second covering strips is folded over the upper longitudinal edge of one of the second divider members of the framework and extends between the junctures with adjacent ones of the first divider members or between an opposite end of one of the second divider members and the juncture with an adjacent one of the first divider members. In such manner, the first and second covering strips completely cover the first and second divider members of the framework and there is a substantially greater number of second covering strips than first covering strips. Each of the first and second covering strips is preferably a substantially flexible sheet of material having opposite surfaces and an adhesive coating is applied on one of the opposite surfaces which secures the covering strip to oppositely facing surfaces of the first and second divider members of the framework and to itself.

The present invention is also directed to a golf club organizing assembly which comprises: (a) a molded one-piece framework constituting an interior component of the organizing assembly, the framework including (i) pluralities of first and second divider members, (ii) each of the first and second divider members having opposite ends and opposite spaced upper and lower longitudinal edges extending between the opposite ends, (iii) the first divider members extending in intersecting relationships with the second divider members so as to form a plurality of junctures therewith and a plurality of compartments between the first and second divider members of the framework for receiving shafts of golf clubs placed in the carrying bag; (b) a golf bag top collar constituting an exterior component of the organizing assembly, the top collar including an annular body encircling the framework; and (c) means defined on the framework and on the top collar for securing the framework to the top collar.

The securing means includes the plurality of connector tabs integrally fixed on the opposite ends of more than half of the first and second divider members of the framework and the plurality of apertures defined through the annular body in spaced apart relation to one another along the circumference of the annular body. Each of the apertures receives a respective one of the connector tabs for securing the framework to the top collar such that the annular body is retained in a wrapped relation about the framework.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
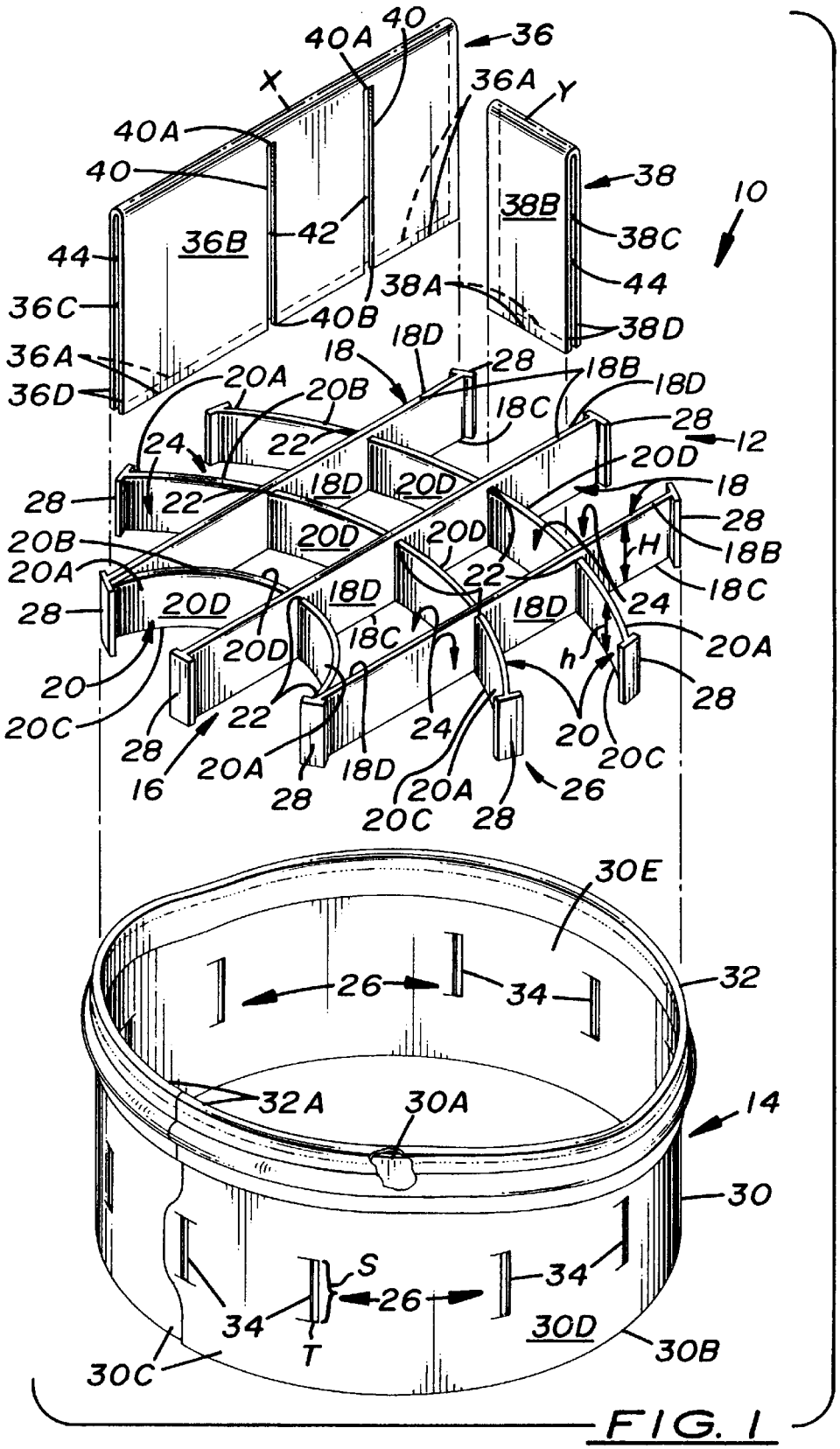
FIG. 1 is an exploded perspective view of a molded one-piece golf club organizer structure and organizing assembly of the present invention.
Figure 2:
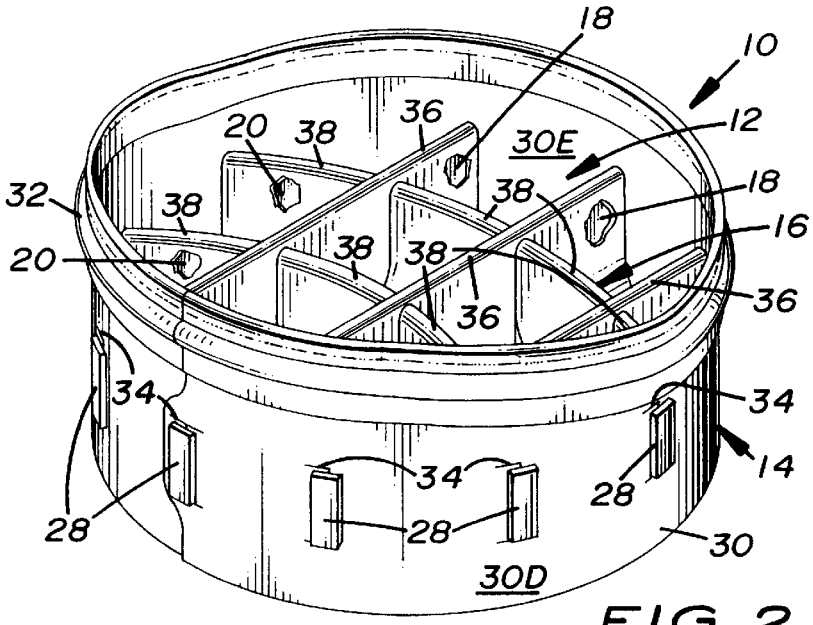
FIG. 2 is an assembled perspective view of the molded one-piece golf club organizer structure and organizing assembly of FIG. 1.
Figure 4:
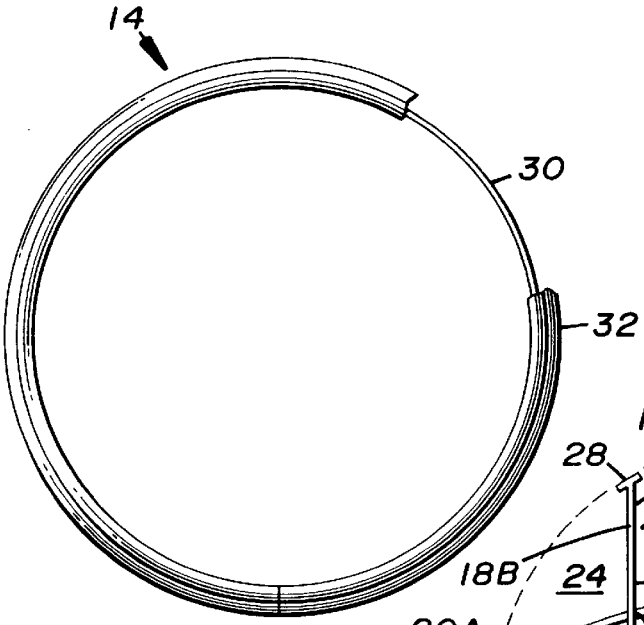
FIG. 4 is a top plan view of a golf bag top collar, with a portion broken away, constituting an exterior component of the organizing assembly.

Referring to the drawings and particularly to FIGS. 1 and 2, there is illustrated a golf club organizing assembly, generally designated 10, of the present invention. The golf club organizing assembly 10 basically includes a molded one-piece golf club organizer structure 12, also a feature of the present invention, which constitutes an interior component of the organizing assembly 10, and a golf bag top collar 14 which constitutes an exterior component of the organizing assembly 10. The organizing assembly 10 defines an array or arrangement of locations for receiving golf clubs (not shown) in a golf bag (not shown) which are designed to shape and distribute the storage space available in the golf bag in a manner which bears a direct logical relationship to how most golfers would desire to organize their clubs in the bag. The arrangement of clubs by the organizing assembly 10 also minimizes contact between adjacent clubs and thereby reduces the wear on handgrips and number of dings and nicks on the club heads. The organizing assembly 10 achieves such attributes with a simple two-piece construction.

Figure 3:
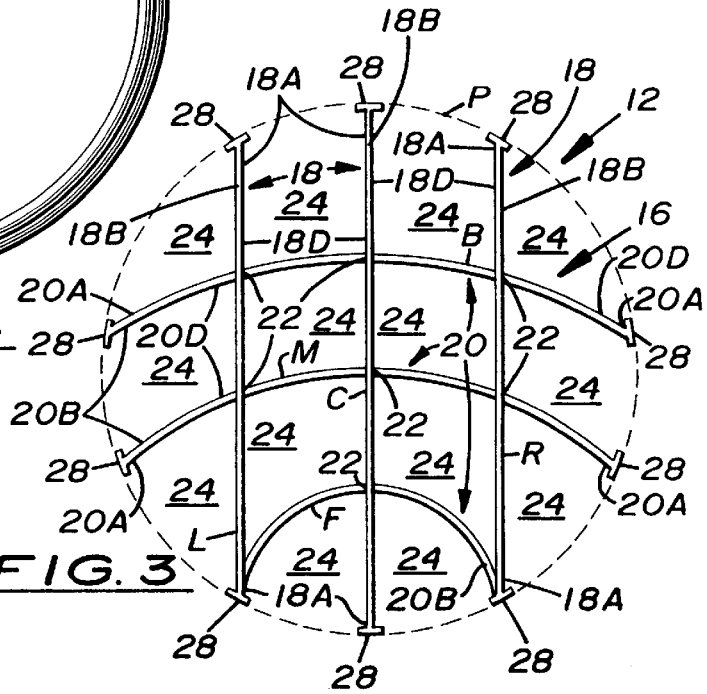
FIG. 3 is a top plan view of the molded one-piece golf club organizer structure constituting an interior component of the organizing assembly.

Referring now to FIGS. 1 to 3, the molded one-piece golf club organizer structure 12 of the organizing assembly 10 includes a molded one-piece framework 16 having pluralities of first and second divider members 18, 20. Each of the first and second divider members 18, 20 has opposite ends 18A, 20A, spaced upper and lower longitudinal edges 18B, 18C and 20B, 20C extending between the opposite ends 18A, 20A, and oppositely facing surfaces 18D, 20D extending between the upper and lower longitudinal edges 18B, 18C and 20B, 20C. The first divider members 18 extend in intersecting relationships with the second divider members 20 so as to form a plurality of junctures 22 therewith and a plurality of compartments 24 therebetween for receiving shafts of golf clubs (not shown) placed in a carrying bag (not shown). The organizer structure 12 also includes means, generally designated 26, for securing the framework 16 to the top collar 14 of the carrying bag.

Each first divider member 18 of the framework 16 preferably has a substantially straight configuration, though it need not be so limited. Each second divider member 20 of the framework 16 preferably has a substantially curved configuration, though it need not be so limited. The framework 16 preferably includes three first divider members 18 and three second divider members 20, though may have any other suitable number of either the first or second divider members 18, 20, and forms fourteen compartments 24, though may form any other suitable number of compartments 28. Each of the first divider members 18 of the framework 16 has a height H which is greater than the height h of each of the second divider members 20 such that the upper longitudinal edges 18B of the first divider members 18 are disposed above the upper longitudinal edges 20B of the second divider members 20. However, the lower longitudinal edges 18C, 20C of the first and second divider members 18, 20 are substantially disposed in a common plane or are flush with one another. The upper longitudinal edges 18B of the first divider members 18 thus extend above the upper longitudinal edges 20B of the second divider members 20. The organizer structure 12 is preferably fabricated from a suitable plastic as one piece employing conventional injection molding techniques. The first and second divider members 18, 20 of the molded one-piece organizer structure 12, although integrally connected to one another and relative stiff overall so as to retain their desired shape are somewhat bendable and flexible so as to facilitate their being assembled with the top collar 14 of the golf bag.

The first divider members 18 can be distinguished from one another by identifying them individually as right R, center C and left L. The right and left ones R, L of the first divider members 18 have substantially the same length. The center one C of the first divider members 18 has a length slightly greater than the lengths of the right and left ones R, L of the first divider members 18. The second divider members 20 can be distinguished from one another by identifying them individually as front F, middle M and back B. The front one F of the second divider members 20 has a substantially greater degree of curvature than do either of the middle and back ones M, B of the second divider members 20. Of the middle and back ones M, B of the second divider members 20, the middle one M has a slightly greater degree of curvature. The front one F of the second divider members 20 merges at its opposite ends 20A with the opposite ends 18A of the right and left ones R, L of the first divider members 18.

The securing means 26 of the organizer structure 12 includes a plurality of connector tabs 28 integrally fixed on the opposite ends 18A, 20A of at least more than half and, preferably, all of the first and second divider members 18, 20 of the framework 16. The connector tabs 28 are provided for securing the organizer structure 12 at the opposite ends 18A, 20A of the first and second divider members 18, 20 to the top collar 14 of the golf club carrying bag. Each connector tab 28 extends in opposite directions from the opposite end 18A, 20A of those of the first and second divider members 18, 20 having the connector tabs 28 to provide a generally T-shaped configuration therewith such that the connector tabs 28 together lie along an annular path P, shown as a dashed line in FIG. 3, conforming to a shape of the top collar 14 of the carrying bag to which the framework 16 is secured by the connector tabs 28. Each connector tab 28 on the opposite ends 18A of the center one C of the first divider members 18 is disposed in substantially perpendicular relation to the oppositely facing surfaces 18D thereof and extends in opposite directions therefrom through substantially the same distance outwardly therefrom. Each connector tab 28 on the right and left ones R, L of the first divider members 18 is disposed in an angled relation to the oppositely facing surfaces 18D thereof and extends in opposite directions therefrom but farther toward the center one C of the first divider members 18 than away therefrom. The connector tabs 28 on the front one F of the second divider members 20 are the same as the connector tabs 28 on the adjacent ends 18A of the right and left ones R, L of the first divider members 18. Each connector tab 28 on the middle and back ones M, B of the second divider members 20 is disposed in an angled relation to the oppositely facing surfaces 20D thereof and extends in opposite directions therefrom but farther toward the front one F of the second divider members 18 than away therefrom.

Figure 5:
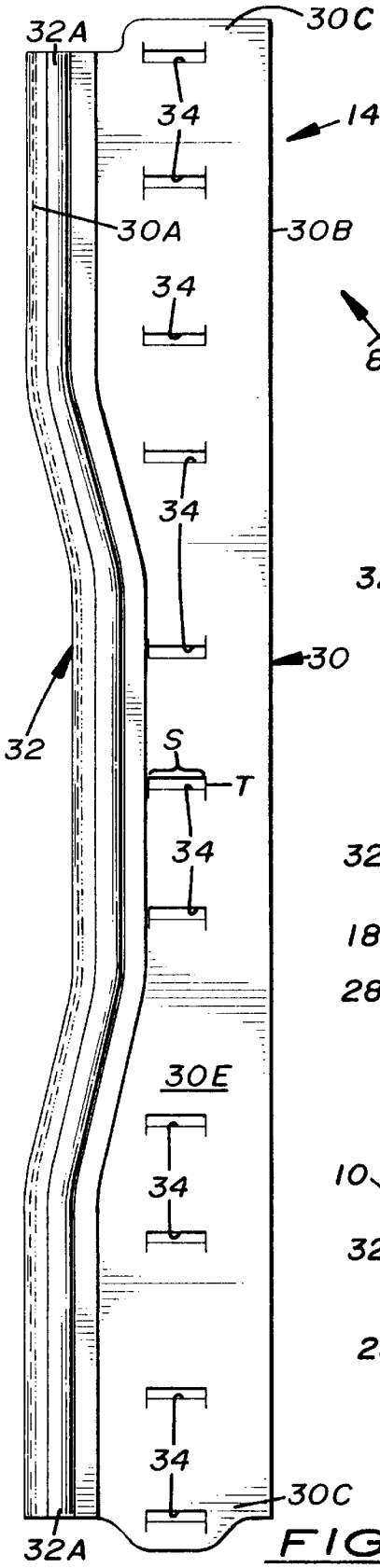
FIG. 5 is a planar layout view of the golf bag top collar of the organizing assembly.
Figure 6:
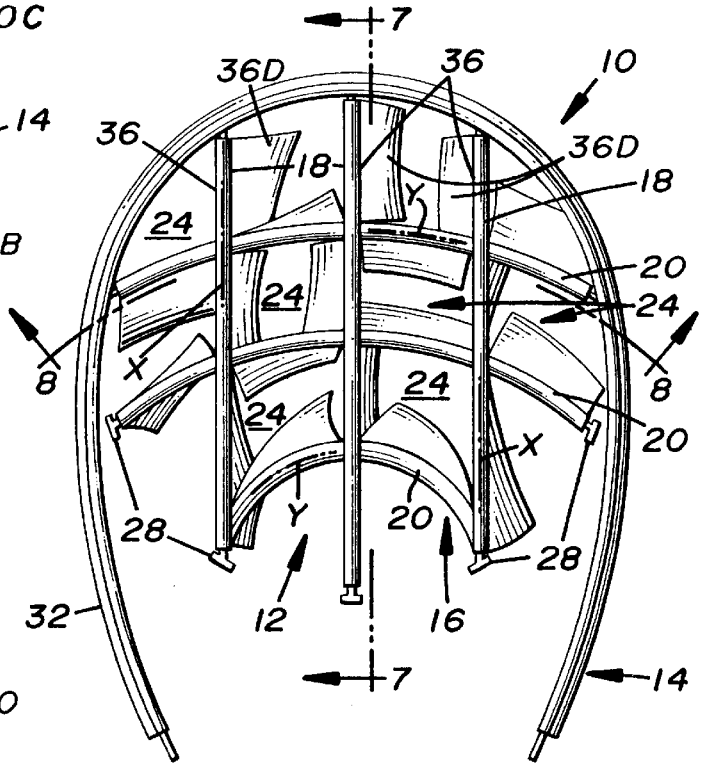
FIG. 6 is a top plan view of the organizing assembly of FIG. 1 showing the top collar halfway assembled about a back side of the organizer structure.
Figure 7:
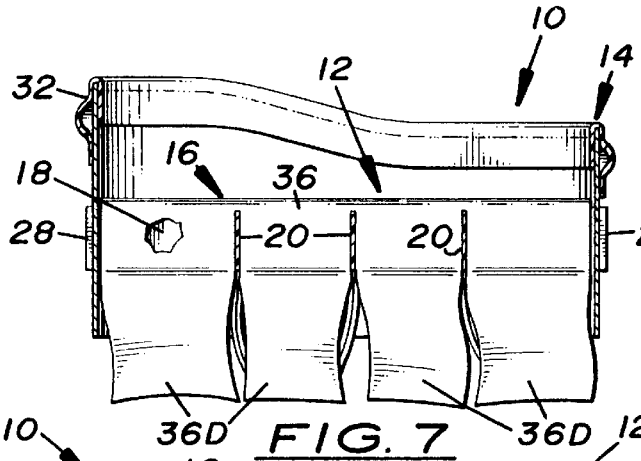
FIG. 7 is a longitudinal sectional view of the organizing assembly taken along line 7—7 of FIG. 6.
Figure 8:
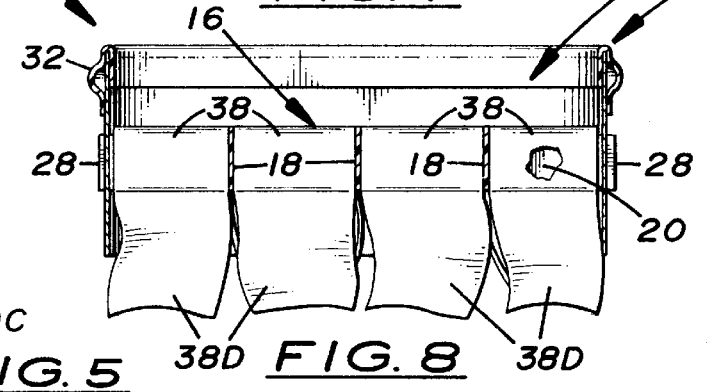
FIG. 8 is a curved transverse sectional view of the organizing assembly taken along line 8—8 of FIG. 6.

Referring now to FIGS. 1, 2, 4 and 5, the golf bag top collar 14 of the organizing assembly 10 includes an annular body 30 encircling the framework 16. Viewed in the flat layout form shown in FIG. 5, the annular body 30 has a height Z, although varying somewhat along the circumference (or the length as seen in FIG. 5) of the annular body 30, which is substantially greater than the heights H, h of the first and second divider members 18, 20 of the organizer structure 12. The annular body 30 has opposite top and bottom edges 30A, 30B, opposite ends 30C and opposite outer and inner surfaces 30D, 30E. The variation in height Z of the annular body 30 occurs gradually over its circumference such that its height nearer to the front one F of the second divider members 20 is less than its height nearer to the back one B of the second divider members 20. The annular body 30 also has a protective covering 32 which is disposed over the top edge 30A and onto the outer and inner surfaces 30D, 30E and extends the full circumference (or longitudinal length) of the annular body 30. The protective covering 32 may cover more of the outer surface 30D than the inner surface 30E thereof. The protective covering 32 is sewn to each of the outer and inner surfaces 30D, 30E adjacent top edge 30A. The protective covering 32 may have a decorative configuration on the outer surface 30D, such as one which resembles a rounded ridge. The annular body 30 is preferably comprised of a material which is more flexible than that which comprises the first and second divider members 18, 20, though may be made of any other suitable material.

The securing means 26 further includes a plurality of apertures 34 defined therethrough in spaced apart relation to one another along the circumference (or longitudinal length) of the annular body 30. Each aperture 34 has substantially C-shaped or I-shaped configuration or any other suitable shape and has a height S (extending along the height Z of the annular body 30) which is greater than a width T of the aperture 34. Each aperture 34 receives a respective one of the connector tabs 28 integrally fixed on the opposite ends 18A, 20A of the first and second divider members 18, 20 of the framework 16 for securing the framework 16 to the top collar 14 such that the annular body 36 is retained in a wrapped relation about the framework 16. The annular body 36 has eleven of the apertures 34 which is one more than the number of connector tabs 28. The apertures 34 are positioned in spaced relation to one another along the circumference (or longitudinal length) of the annular body 30 such that each of the apertures 34 may receive one of the connector tabs 28. Each aperture 34 is spaced from the top and bottom edges 30A, 30B of the annular body 30. The apertures 34 receiving the rear connector tabs 28 of the first divider members 18 are spaced approximately halfway between the top and bottom edges 30A, 30B of the annular body 30. The apertures 34 receiving the other connector tabs 28 of the first and second divider members 18, 20 are spaced closer to the bottom edge 30B than to the top edge 30A of the annular body 30. The opposite ends 30C of the annular body 30 are overlapped to align the apertures 34 therein with one another so that both receive the front connector tab 28 of the center one C of the first divider members 18 therethrough. The opposite ends 32A of the protective cover 32 are also overlapped and riveted together.

Referring now to FIGS. 1, 6 to 8, the molded one-piece golf club organizer structure 12 of the organizing assembly 10 may also include a plurality of first and second covering strips 36, 38 respectively applied over the first and second divider members 18, 20 of the framework 16 and along the oppositely facing surfaces 18D, 20D of the first and second divider members 18, 20 so as to protect the shafts of the golf clubs and to provide an attractive appearance to the assembly 10. Each of the first covering strips 36 is folded along an imaginary longitudinal fold line X over the upper longitudinal edge 18B of one of the first divider members 18 and is continuous between the opposite ends 18A of the first divider member 18 along the upper longitudinal edge 18B so as to completely overlie and cover the higher upper longitudinal edge 18B of the first divider member 18. Each of the first covering strips 36 has a pair of opposite longitudinal edges 36A and opposite outer and inner surfaces 36B, 36B. Also, each of the first covering strips 36 has a pair of aligned slits 40 respectively formed in the first covering strip 36 transversely to the imaginary longitudinal fold line X and at the junctures 22 of the first divider member 18 with the second divider members 20 to provide slots 42 in the first covering strip 36 for accommodating the second divider members 20 of the framework 16. The slits 40 of each pair thereof has inner ends 40A spaced apart in opposite directions from the imaginary longitudinal fold line X of the first covering strip 36 and extend to outer ends 40B located at the opposite longitudinal edges 36A of the first covering strip 36 such that the slots 42 are open at the opposite longitudinal edges 36A thereof.

Each of the second covering strips 38 is folded over the upper longitudinal edge 20B of one of the second divider members 20 of the framework 16 and extends between the junctures 22 with adjacent ones of the first divider members 18 or between an opposite end 20A of one of the second divider members 20 and the juncture 22 with an adjacent one of the first divider members 18. In such manner, the first and second covering strips 36, 38 completely cover the first and second divider members 18, 20 of the framework 18 and there is a substantially greater number of second covering strips 38 than first covering strips 36. Each of the first and second covering strips 36, 38 is preferably a substantially flexible sheet of material, and has an adhesive coating 44 applied on the inner surface 36C, 38C of the respective covering strip 36, 38. The adhesive coating 44 secures the respective covering strip 36, 38 to the corresponding one of the oppositely facing surfaces 18D, 20D of the first and second divider members 18, 20 of the framework 16 and to itself at lower portions 36D, 38D of the covering strips 36, 38 extending below the divider members 18, 20 of the organizer structure 12. Each of the first covering strips 36 has a longitudinal length substantially greater than a folded height. Each of the second covering strips 38 has a folded height greater than a longitudinal length. The organizer structure 12 particularly includes three first covering strips 36 and ten second covering strips 38, though may have any other suitable number of either the first or second covering strips 36, 38, depending upon the number of divider members 18, 20. The first and second divider members 18, 20 of the framework 16 must have the aforementioned different heights for the first and second covering strips 36, 38 to cover all surfaces of the first and second divider members 18, 20 of the framework 16. Each first and second covering strip 36, 38 is comprised of a substantially neoprene material, though may be made of any other suitable material. Once the covering strips 36, 38 are applied, their outer surfaces 36B, 38B are exposed to the golf clubs.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A golf club organizing assembly for a golf club carrying bag, said organizing assembly comprising:

(a) a molded one-piece framework constituting an interior component of said organizing assembly, said framework including (i) pluralities of first and second divider members, (ii) each of said first and second divider members having opposite ends and spaced upper and lower longitudinal edges extending between said opposite ends, (iii) said first divider members extending in intersecting relationships with said second divider members so as to form a plurality of junctures therewith and a plurality of compartments between said first and second divider members for receiving shafts of golf clubs placed in the carrying bag;

(b) a golf bag top collar constituting an exterior component of said organizing assembly, said top collar including an annular body encircling said framework; and (c) means defined on said framework and on said top collar for securing said framework to said top collar, said securing means including (i) a plurality of connector tabs integrally fixed on said opposite ends of more than half of said first and second divider members of said framework, and (ii) a plurality of apertures defined through said annular body in spaced apart relation to one another along a circumference of said annular body, each of said apertures receiving a respective one of said connector tabs for securing said framework to said top collar and such that said annular body is retained in a wrapped relation about said framework.

2. The assembly of claim 1 wherein said connector tabs at said opposite ends of those of said first and second divider members having said connector tabs extend in opposite directions from said opposite ends of said divider members to provide generally T-shaped configurations therewith and lie along an annular path conforming to a shape of said annular body of said top collar of the carrying bag to which said framework is secured by said connector tabs.

3. The assembly of claim 1 wherein:

each of said first divider members has a height greater than a height of each of said second divider members such that said upper longitudinal edge of each of said first divider member is disposed above said upper longitudinal edge of each of said second divider members; and said assembly further comprises a plurality of first and second covering strips respectively applied over said first and second divider members of said framework and along said oppositely facing surfaces thereof.

4. The assembly of claim 3 wherein each of said first covering strips is folded along an imaginary longitudinal fold line over said upper longitudinal edge of one of said first divider members of said framework and is continuous between said opposite ends of said first divider along said upper longitudinal edge so as to completely overlie and cover said higher upper longitudinal edge of said first divider member.

5. The assembly of claim 4 wherein each of said first covering strips has a pair of opposite longitudinal edges and pairs of spaced apart and aligned slits respectively formed in said first covering strip transversely to said imaginary longitudinal fold line and at said junctures of said first divider members with said second divider members to provide slots in said first covering strip for accommodating said second divider members of said framework.

6. The assembly of claim 5 wherein said slits of each pair thereof having inner ends spaced apart in opposite directions from said imaginary longitudinal fold line of said first covering strip and extend to outer ends located at said opposite longitudinal edges of said first covering strip such that said slots are open at said opposite longitudinal edges thereof.

7. The assembly of claim 3 wherein each of said second covering strips is folded over said upper longitudinal edge of one of said second divider members of said framework and extends between said junctures with adjacent ones of said first divider members or between an opposite end of one of said second divider members and a respective one of said junctures with an adjacent one of said first divider members such that said first and second covering strips completely cover said first and second divider members of said framework.

8. The assembly of claim 3 wherein each of said first and second covering strips is a substantially flexible sheet of material having opposite surfaces and an adhesive coating applied on one of said opposite surfaces which secures said first and second covering strips to said oppositely facing surfaces of said first and second divider members of said framework.

* * * * *